US006486103B1

(12) United States Patent
Burdzy et al.

(10) Patent No.: US 6,486,103 B1
(45) Date of Patent: Nov. 26, 2002

(54) FLUORINATED OIL-CONTAINING COMPOSITIONS

(75) Inventors: Matthew P. Burdzy, South Windsor, CT (US); Sandra C. Adams, East Hampton, CT (US); Edward A. Y. Fisher, Rocky Hill, CT (US)

(73) Assignee: Henkel Loctite Corporation, Rocky Hill, CT (US)

( * ) Notice: Subject to any disclaimer, the term of this patent is extended or adjusted under 35 U.S.C. 154(b) by 0 days.

(21) Appl. No.: 09/787,429

(22) PCT Filed: Sep. 24, 1999

(86) PCT No.: PCT/US99/21776

§ 371 (c)(1),
(2), (4) Date: Mar. 26, 2001

(87) PCT Pub. No.: WO00/18210

PCT Pub. Date: Apr. 6, 2000

Related U.S. Application Data

(60) Provisional application No. 60/102,281, filed on Sep. 29, 1998.

(51) Int. Cl.[7] ..... C10M 105/50; C10M 131/06

(52) U.S. Cl. ..... 508/582; 508/588

(58) Field of Search ..... 508/582, 588

(56) References Cited

U.S. PATENT DOCUMENTS

| | | | | | |
|---|---|---|---|---|---|
| 4,097,388 | A | * | 6/1978 | Snyder, Jr. et al. | 508/583 |
| 4,443,349 | A | | 4/1984 | Snyder, Jr. et al. | 252/49.9 |
| 5,032,302 | A | * | 7/1991 | Juhike et al. | 508/582 |
| 5,076,949 | A | * | 12/1991 | Kalota et al. | 508/582 |
| 5,124,058 | A | * | 6/1992 | Corti et al. | 508/582 |
| 5,154,845 | A | | 10/1992 | Williams | 252/54 |
| 5,498,359 | A | * | 3/1996 | Shinomoto et al. | 508/582 |
| 5,663,127 | A | * | 9/1997 | Flynn et al. | 508/250 |
| 5,698,138 | A | * | 12/1997 | Visca et al. | 252/312 |
| 6,303,549 | B1 | * | 10/2001 | Burdzy et al. | 508/582 |
| 6,329,326 | B1 | * | 12/2001 | Iso et al. | 508/182 |

* cited by examiner

*Primary Examiner*—Ellen M. McAvoy
(74) *Attorney, Agent, or Firm*—Steven C. Bauman

(57) ABSTRACT

An aerosol solvent and co-solvent system provides for a more miscible fluorinated oil composition so that typical oil additives such as anti-wear, extreme pressure, lubricity additives, corrosion inhibitors, and oxidation inhibitors may be combined with perfluorinated and highly fluorinated oils.

38 Claims, No Drawings

FLUORINATED OIL-CONTAINING COMPOSITIONS

This application claims the benefit of provisional application 60/102,281 filed Sep. 29, 1998.

BACKGROUND OF THE INVENTION

1. Field of the Invention

The present invention relates generally to fluorinated oil compositions used as lubricants. More specifically, the present invention relates to a solvent system for rendering fluorinated oil more miscible with oil additives and which can also be formulated into an effective aerosol system.

2. Brief Description of Related Technology

Perfluorinated oil compounds and highly fluorinated oil compounds are lubricants known to maintain their outstanding properties under severe chemical and thermal conditions. Whereas elevated temperatures, aggressive chemicals, flammable conditions and airborne contaminants can quickly exceed the performance capabilities of many hydrocarbon lubricants, this is not the case for fluorinated lubricants. One such class of perfluorinated oil compounds is perfluoropolyethers ("PFPE"). These compounds are low molecular weight fluorine endcapped homopolymers of hexafluoropropylene oxide. One group of commercially available PFPEs is sold by DuPont under the tradename KRYTOX GP-101 and has the formula as $F(CF(CF_3)CF_2O)_n—CF_2CF_3$, where n is an integer from 10 to 60.

The primary technical difficulty, however, with using perfluorinated compounds in commercial applications is that they are not miscible with or soluble in most substances, except perhaps certain other highly fluorinated materials which are so costly to produce they are not commercially attractive as solvents for these fluorinated oils.

The inability of perfluorinated oils to form single phase compositions with most substances also effects the ability to include oil additives which are conventionally employed and are often necessary in many extreme condition applications. The conventional additives used with lubricating oils are also typically not miscible with perfluorinated oils. For example, many lubricants contain additives such as anti-wear agents, extreme pressure agents, corrosion inhibitors, lubricity additives and the like which are combined with the oil to not only impart their properties to the oil but also to thicken the oil into a paste or grease. When these additives are used with PFPEs, they tend to separate from the oil and form separate liquid and solid phases.

A number of patents disclose cleaning compositions which have a perfluorinated solvent compound in combination with partially fluorinated or non-fluorinated solvents to form solvent systems or azeotropic compositions. For example, U.S. Pat. Nos. 5,401,429, 5,484,489, 5,594,601 and 5,744,436 disclose a combination of a perfluorinated cycloaminoether and an organic solvent to form an azeotropic cleaning organic solvent to form an azeotropic cleaning compound. Other cleaning compositions are disclosed in U.S. Pat. Nos. 5,401,514 (a degreasing solvent having 40% by volume or more of a perfluorocarbons); U.S. Pat. No. 5,744,437 (a cleaning composition having 2–20% benzotrifluoride, 5–50% glycolether, 2–40% alkane and 7–56% water); and U.S. Pat. No. 5,756,002 (a two-part, single-phase cleaning solvent having from 3–20% by weight of a fluorinated compound and the remainder of the composition being benzotrifluoride).

None of these patents, however, disclose compositions which contain a fluorinated oil as part of the composition, i.e., a delivery system for a fluorinated oil. Moreover, none of these patents show a fluorinated oil in an aerosol composition. Effective aerosol compositions contain solvents or carrier materials for the oil which also have the ability to rapidly evaporate once it delivers the oil to the substrate. In order to have wide commercial acceptability, this should be achieved at an affordable cost, particularly since the primary purpose of the solvent is to carry the oil to its intended surface.

Heretofore, there has not existed a fluorinated oil-containing composition which possesses the aforementioned properties and which could be made into an aerosol form. The present invention provides such a composition.

SUMMARY OF THE INVENTION

One advantage of the present invention is that it provides a composition to deliver perfluorinated and highly fluorinated oil lubricants. In particular PFPE oils are found to be especially useful and can be combined with conventional oil additives to provide a stable single-phase composition.

Another advantage of the present invention is that it provides compositions which are effective aerosol delivery systems for fluorinated oils.

In one embodiment, the present invention provides a fluorinated oil composition including a fluorinated oil first component; and a fluorinated aromatic second component, such as a substituted benzene second component selected from parachlorobenzotrifluoride, monochlorotoluene, 3,4-dichlorobenzotrifluoride, alpha, alpha, alpha-trifluorotoluene, and combinations thereof.

In another embodiment, the present invention provides a fluorinated oil composition including a fluorinated oil first component, a fluorinated aromatic second component such as a substituted benzene second component selected from parachlorobenzotrifluoride, monochlorotoluene, 3,4-dichlorobenzotrifluoride, alpha, alpha, alpha-trifluorotoluene, and combinations thereof; and optionally a highly fluorinated third component including a fluorinated alkane having from four to ten carbon atoms, such as those selected from the group consisting of perfluorocarbons, dihydropolyfluoroalkanes having 5 to 7 carbons, trihydropolyfluoroalkanes having 5 to 7 carbons, and combinations thereof. Decafluoropentane is one such commercially available material. Due to the combination of the first two components of the present invention, significantly lower amounts of the more costly optional fluorinated alkane can be effectively employed without creating a prohibitively costly product.

An article of manufacture is also provided for in the present invention. The article of manufacture includes a container for a flowable composition; and a flowable composition contained therein. The composition within the container includes a fluorinated oil first component; and a fluorinated aromatic second component. The composition can further include a propellant. The composition may further include a fluorinated third component comprising a fluorinated alkane having from four to ten carbon atoms, which is a very desirable embodiment due to its single phase form. Although the composition most desirably exists in a single phase, dispersions, emulsions and other combinative forms are contemplated.

A method of forming a fluorinated oil composition is further provided. The method comprises providing a first fluorinated oil component, and combining the fluorinated aromatic second component thereto. A highly fluorinated third component, as described above, may also be added. A method of using a fluorinated oil composition as a cleaner and delivery vehicle is also provided.

DETAILED DESCRIPTION OF THE INVENTION

Most commercially available fluorinated oils are clear, fluorinated, synthetic oils that are non-reactive, non-flammable, safe in chemical and oxygen service, and are long lasting. One such class of fluorinated oils is known as perfluoropolyethers ("PFPE"), and is also called perfluoroalkylethers ("PFAE"), or perfluoropolyalkylethers ("PFPAE"). Among the perfluoropolyethers useful in the present invention are those corresponding to the following general chemical formula:

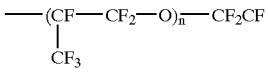

where n is an integer from 10 to 60. These oils are commercially available under the tradename KRYTOX, from DuPont, Wilmington, Del.

Other fluorinated oils which may be used in the present invention include compounds within the formulas:

$CF_3CF_2CF_2—O—[CF(CF_3)CF_2—O]_nCF_2CF_3$, $CF_3O[CF(CF_3)CF_2—O]_y—[CF_2—O]_mCF_3$, $CF_3O[CF_2CF_2—O—]_z—[CF_2—O—]_pCF_3$, $CF_3CF_2CF_2—O—[CF_2CF_2CF_2—O—]_qCF_2CF_3$, and halocarbons containing the repeating group $—(CF_2CFCl)_r—$ and having an average molecular weight of from about 230 to about 1,200, and combinations thereof, where n is an integer from 0 to 60; y is an integer from 0 to 60; m is an integer from 0 to 60; z is an integer from 0 to 60; p is an integer from 0 to 60; q is an integer from 0 to 60; and r is an integer from 2 to 10.

As previously mentioned, conventional oil additives separate out from perfluorinated oils. This makes the resultant combination much less effective overall and may prevent its use in certain high temperature applications. The present invention has discovered that wherein certain fluorinated aromatic compounds are combined with the perfluorinated oil, this problem is greatly alleviated. Moreover, with the addition of a highly fluorinated third component, a single phase is achievable which facilitates the composition being prepared into an aerosol form.

It has been discovered, however, that the addition of a fluorinated aromatic compound, as disclosed here, to perfluorinated oils such as PFPE results in a newly formed composition which can accommodate additives suffering from the phase separation previously discussed.

The fluorinated aromatic compound may be a substituted benzene component selected from the group consisting of parachlorobenzotrifluoride, monochlorotoluene, 3,4-dichlorobenzotrifluoride, alpha, alpha, alpha-trifluorotoluene, and combinations thereof.

The compositions of the present invention once formed, however, are most desirably in a single phase system. Single phase systems allow for more effective lubricants and delivery systems to be made, particularly when difficult to dissolve materials such as fluorinated oils are involved. However, while the single phase system is the most desirable physical form of the present compositions, emulsions, dispersions, or other combinative forms may be formulated to meet a wide variety of applications.

One particularly desirable embodiment of the present invention is a co-solvent composition for a perfluorinated oil including a combination of the fluorinated aromatic component and another highly fluorinated component. The highly fluorinated component may be a fluorinated alkane having from four to ten carbon atoms, selected from perfluorocarbons, dihydropolyfluoroalkanes having 5 to 7 carbons, trihydropolyfluoroalkanes having 5 to 7 carbons, and combinations thereof. Decafluoropentane has been found to be an example of such a fluorinated component which is commercially available from DuPont under the tradename VERTREL XF. Although these highly fluorinated components are very expensive relative to the fluorinated aromatic component and non-fluorinated additives, the compositions of the present invention allow for their incorporation into the compositions of the present invention in relatively smaller amounts to enhance the ability to achieve a single phase. One embodiment of the present invention includes a combination of a fluorinated substituted benzene component; and another highly fluorinated component, such as a highly fluorinated alkane, present in a 1:1 ratio by weight relative to each other; and further including a fixed amount of PFPE oil.

It has been discovered that the relative amounts of the components of the composition can be adjusted to provide a single phase solvent system. When their proportions are adjusted to within certain ranges, they form a single-phase multi-component solvent system which exhibits phase stability. To form a single phase solvent system, the most desired combination of the fluorinated aromatic component, the fluorinated alkane component, and the fluorinated oil is in an approximate ratio of 1:1:1 by weight, respectively. The fluorinated oil component may be present in amounts greater than this, however. Table 1 below shows various compositions of the present invention.

TABLE 1

| Component Type/Identity | | Composition/Percent by Weight (Grams) | | | |
|---|---|---|---|---|---|
| | | A | B | C | D |
| Fluorinated oil | PFPE* | 55 (8.9) | 29 (4.9) | 38 (4.9) | 29 (4.9) |
| Fluorinated aromatic compound | Benzotrifluoride | 15 (2.3) | 41 (7) | 34 (4.3) | 31 (4) |
| Highly Fluorinated compound | Decafluoropentane | 30 (4.9) | 30 (5) | 28 (3.7) | 31 (4) |
| Observations | | Clear; single phase | Slightly turbid; single phase | Slightly turbid; single phase | Clear; single phase |

*$F[CF(CF_3)CF_2O]_n—CF_2CF_3$; n = 10 to 60

The numbers indicate the weight percent of each component in the total composition. In each case the resultant compositions were observed to be a single phase. "Slightly turbid" indicates that the mixture is not entirely clear, but the composition has still formed a single phase. Compositions C and D represent the more desired combined ratio of the two fluorinated components (benzotrifluoride plus decafluoropentane) to oil (PFPE); i.e., 2:1 ratio of total fluorinated solvent components to fluorinated oil.

Different ratios of the above-mentioned components may still be useful, however, if a stable single phase is not the desired state. For example, if phase separation is suitable for the particular application, where the addition of a compatibilization component or agitation would result in a useful emulsion, dispersion, suspension or combination of a discontinuous phase and continuous phase, the proportion of the components may be other than the ratios stated above. Further, the combination of the fluorinated oil and the fluorinated aromatic component will not form a single phase alone. The three components together make the composition a single phase.

In a single-phase embodiment of the invention, the fluorinated oil first component may be generally present in amounts of about 1% to about 55% by weight of the first and second components; and the fluorinated aromatic second component may be generally present in amounts of about 15% to about 50% by weight of the two components. In such compositions the propellant and other additives may be added in any useful amounts.

In a multi-phase embodiment of the present invention, the fluorinated oil first component may be generally present in amounts of about 1% to about 99% by weight of the first and second components; and the fluorinated aromatic second component may be generally present in amounts of about 99% to about 1% by weight.

For purposes of the present invention, the term "non-flammable" will mean a flash-point of greater than about 200° F. (94° C.), whereby heating is required for the material to catch fire; and the term "flammable" will mean the material is ignitable with a spark rather than by heating, and having a flash-point of about less than 100° F. (38° C.). Generally, compounds which have a flash-point between 140–200° F. (60–93° C.) are classified as combustible. The above definitions are believed to be generally accepted ones in accordance with those set by the U.S. Department of Transportation (DOT).

As previously mentioned, fluorinated oil and grease lubricants are desirably combined with additives to enhance the performance of such lubricants. Non-limiting examples of useful additives include compounds and classes of compounds which fall into the categories of anti-wear and extreme pressure additives, friction or lubricity modifiers, corrosion inhibitors, oxidation inhibitors, thermal stabilizers, and the like. Combinations of these additives are also contemplated. These materials can be included in amounts sufficient to impart their intended function and effect.

One particularly useful additive is a low molecular weight particulate, e.g., micron size, polytetrafluoroethylene ("PTFE"). This additive serves as both a thickener and a lubricating aid or lubricity modifier.

Some anti-wear additives which may be used with the lubricants may be selected from the group consisting of phosphates, sulfides, carbamates, fats, and paraffins. More specifically, some anti-wear and extreme pressure additives include, but are not limited to zinc dialkyldithiophosphate, molybdenum disulfide, tricresyl phosphate, alkyl and aryl disulfides, polysulfides, dithiocarbamates, sulfurized fats, chlorinated paraffins, and non-chlorinated replacements. Combinations of these modifiers are also contemplated.

Some corrosion inhibitors which may be used with the fluorinated oil composition may be selected from the group consisting of amines, sodium compounds, aromatic acids, and the salts thereof, sulfonates, aromatic compounds, dihydric and polyhydric alcohols and organic phosphates. More specifically, some corrosion inhibitors include, but are not limited to long-chain amines, alkyl succinic acids, mildly polar organic acids (salts of benzoic acid), amine salts, sodium nitrite, sodium molybdate, sodium sulfonate, calcium sulfonate, organic phosphates, polyhydric alcohols, dicyclohexylamine, triazole derivatives, and cycloparaffin (naphthenate) salts. Combinations of these modifiers are also contemplated.

Some additives to enhance lubricity which may be used with the fluorinated oil compositions may be selected from metal oxides, fluorocarbons, and other carbon-based lubricants. More specifically, the lubricity additives may include, but are not limited to graphite, zinc oxide, and PTFE. Some oxidation inhibitors which may be used with the fluorinated oil compositions of the present invention are hindered amines, such as naphthyl(phenyl)amine, hindered phenols, such as di-tertiary-butyl-p-cresol, and aromatic compounds, such as 2-naphthol. Combinations of these additives are also contemplated.

Stabilizers, viscosity modifiers, odor masking agents, coloring agents, plasticizers, other conventional additives, and combinations thereof may also be employed.

The non-flammability and non-combustibility of the present invention is in strong contrast to other materials, such as isoparaffins or propyleneglycolether, which have been proposed as chlorofluoro hydrocarbon ("CFC") replacements. These conventional solvent materials, while possessing relatively good solvency and volatility properties, are combustible at temperatures below 200° F. (94° C.). Other materials which exhibit excellent solvency properties, such as heptane, acetone, methylethylketone, methanol, propanol and the like are highly flammable, requiring only a spark for ignition. In the present invention, the use of the alkane in combination with the other two components allows for a cost effective, non-combustible and non-flammable material to be made. In addition, good solvency, non-ozone depleting characteristics and quick solvent flash-off or evaporation is also inherent in the inventive compositions.

The fluorinated oil compositions of the present invention may also be used in aerosol form. In a particularly desirable embodiment, the gaseous suspension is compressed in a container with a propellant to disperse the aerosol. The suspended liquid may form a solution, dispersion or emulsion within the propellant. Some aerosol propellants which may be used may be selected from carbon dioxide, dimethylether, isobutane, 1,1,1,2-tetrafluoroethane, and combinations thereof. The propellant may be chosen so that it is soluble or otherwise compatible with the overall composition such that it can be dispensed in a single phase, thereby avoiding separation of the propellant from the other components in the container during storage.

An article of manufacture contemplated within the scope of the present invention includes a container for storing and dispersing the inventive composition contained therein. A dispensing means such as a valve is also contemplated as being included in the article of manufacture. While the aforementioned aerosol version of the present invention takes advantage of many inherent properties of the composition, other forms of applying the composition may be employed. For example, spraying, dipping, brushing, swabbing, wiping, roller coating, and the like, are contemplated.

In a broad method of use aspect, the invention provides a method of using an inventive composition as described herein to compatibilize incompatible materials, such as those which would ordinarily exist in a two phase system in the absence of the inventive composition. More specifically, the method calls for the step of providing said composition to a mixture of two or more incompatible materials.

In addition, the entire contents of co-pending, commonly-assigned U.S. provisional application numbers 60/102,283, filed Sep. 29, 1998 and 60/102,280, filed Sep. 29, 1999 are hereby expressly incorporated herein by reference.

The invention being thus described, it is clear that variations thereof exist. Such variations are not to be regarded as a departure from the spirit and scope of the invention, and all such modifications are intended to be included within the scope of the claims.

What is claimed is:

1. A fluorinated oil composition comprising:

a) a fluorinated oil first component; and b) a fluorinated aromatic second component, wherein the fluorinated aromatic second component is a fluorinated chloro-substituted benzene or toluene selected from the group consisting of parachlorobenzotrifluoride, monochlorotoluene, 3,4-dichlorobenzotrifluoride, alpha, alpha, alpha-trifluorotoluene, and combinations thereof.

2. The composition according to claim 1, wherein the first component is a perfluoropolyether oil.

3. The composition according to claim 1, wherein the first component is within one of the formulas selected from the group consisting of:

$$CF_3CF_2CF_2O—[CF(CF_3)CF_2—O]_nCF_2CF_3,$$

$$CF_3O[CF(CF_3)CF_2—O—]_y—[CF_2—O]_mCF_3,$$

$$CF_3O[CF_2CF_2—O—]_z—[CF_2—O—]_pCF_3,$$

$$CF_3CF_2CF_2—O—[CF_2CF_2CF_2—O—]_qCF_2CF_3,$$

halocarbons containing the repeating group—$(CF_2CFCl)_r$— and combinations thereof, wherein n is an integer from 0 to 60; y is an integer from 0 to 60; m is an integer from 0 to 60; z is an integer from 0 to 60; p is an integer from 0 to 60; q is an integer from 0 to 60; and r is an integer from 2 to 10.

4. The composition according to claim 1, wherein the first component corresponds to the formula $F[CF(CF_3)CF_2O]_n CF_2CF_3$, wherein n is an integer from 10 to 60.

5. The composition according to claim 1, further comprising a material selected from the group consisting of anti-wear and extreme pressure additives, thermal stabilizing additives, corrosion inhibitors, lubricity additives, oxidation inhibitors, and combinations thereof.

6. The composition according to claim 1, wherein the first and second components are in a ratio of about 1:1 to about 4:1.

7. The composition according to claim 1, further including an additional fluorinated component selected from the group consisting of perfluorocarbons, dihydropolyfluoroalkanes having 5 to 7 carbons, trihydropolyfluoroalkanes having 5 to 7 carbons and combinations thereof.

8. The composition according to claim 5, wherein the anti-wear additives are selected from the group consisting of phosphates, sulfides, carbamates, fats, paraffins, and combinations thereof.

9. The composition according to claim 5, wherein the corrosion inhibitors are selected from the group consisting of amines, sodium compounds, aromatic acids and salts thereof, sulfonates, aromatic compounds, dihydric and polyhydric alcohols, organic phosphates, and combinations thereof.

10. The composition according to claim 5, wherein the lubricity additives are selected from the group consisting of metal oxides, fluorocarbons, carbon-based lubricants, and combinations thereof.

11. The composition according to claim 5, wherein the oxidation inhibitors are selected from the group consisting of hindered amines, hindered phenols, aromatic compounds and combinations thereof.

12. The composition according to claim 7, wherein the additional fluorinated component is present in amounts of about 25% to about 31% by weight.

13. The composition according to claim 1, further comprising an aerosol propellant.

14. The composition according to claim 13, wherein the propellant is selected from the group consisting of carbon dioxide, dimethylether, isobutane, 1,1,1,2-tetrafluoroethane, and combinations thereof.

15. A fluorinated oil composition comprising:

a) a fluorinated oil first component;

b) a substituted benzene second component selected from the group consisting of parachlorobenzotrifluoride, monochlorotoluene, 3,4-dichlorobenzotrifluoride, perchloroethylene, alpha, alpha, alpha-trifluorotoluene, and combinations thereof; and c) a fluorinated third component comprising an alkane having from four to ten carbon atoms, wherein the first, second, and third components form a single phase composition.

16. The composition according to claim 15, wherein the third component is selected from the group consisting of perfluorocarbons, dihydropolyfluoroalkanes having 5 to 7 carbon atoms, trihydropolyfluoroalkanes having 5 to 7 carbon atoms, and combinations thereof.

17. The composition according to claim 15, further comprising an aerosol propellant.

18. The composition according to claim 17, wherein the aerosol propellant is selected from the group consisting of carbon dioxide, dimethylether, isobutane, 1,1,1,2-tetrafluoroethane, and combinations thereof.

19. The composition according to claim 15, further comprising a material selected from the group consisting of anti-wear additives, thermal stabilizing additives, corrosion inhibitors, lubricity additives,and combinations thereof.

20. The composition according to claim 19, wherein the anti-wear additives are selected from the group consisting of phosphates, sulfides, carbamates, fats, paraffins, and combinations thereof.

21. The composition according to claim 19, wherein the corrosion inhibitors are selected from the group consisting of amines, sodium compounds, aromatic acids and salts thereof, sulfonates, aromatic compounds, dihydric and polyhydric alcohols, organic phosphates, and combinations thereof.

22. The composition according to claim 19, wherein the lubricity additives are selected from the group consisting of metal oxides, fluorocarbons, carbon-based lubricants, and combinations thereof.

23. The fluorinated oil composition according to claim 19, wherein the oxidation inhibitors are selected from the group consisting of hindered amines, hindered phenols, and aromatic compounds.

24. An article of manufacture comprising:

a) a container for packaging a flowable composition b) a flowable composition within said container, said composition comprising:

i.) a fluorinated oil first component; and ii.) a fluorinated aromatic second component, wherein the fluorinated aromatic second component is a fluorinated chloro-substituted benzene or toluene selected from the group consisting of parachlorobenzotrifluoride, monochlorotoluene, 3,4-dichlorobenzotrifluoride, alpha, alpha, alpha-trifluorotoluene, and combinations thereof.

25. The article according to claim 24, wherein the composition further includes a highly fluorinated third component comprising a highly fluorinated alkane having from 4 to 10 carbon atoms.

26. The article according to claim 25, wherein the composition is in a single phase.

27. The article according to claim 25, wherein the highly fluorinated third component is selected from the group consisting of perfluorocarbons, dihydropolyfluoroalkanes having 5 to 7 carbon atoms, trihydropolyfluoroalkanes having 5 to 7 carbon atoms, and combinations thereof.

28. The article according to claim 24, wherein the container includes means for dispensing the composition.

29. The article according to claim 24, wherein the composition further comprises a propellant.

30. The article according to claim 24, wherein the composition is a dispersion or an emulsion.

31. The article according to claim 29, wherein the propellant is selected from the group consisting of carbon dioxide, dimethylether, isobutane, 1,1,1,2-tetrafluoroethane, and combinations thereof.

32. A method of forming a fluorinated oil composition comprising:

a) providing a first fluorinated oil component; and b) combining said first fluorinated oil component with a fluorinated aromatic compound, wherein the fluorinated aromatic second component is a fluorinated chloro-substituted benzene or toluene selected from the group consisting of parachlorobenzotrifluoride, monochlorotoluene, 3,4-dichlorobenzotrifluoride, alpha, alpha, alpha-trifluorotoluene, and combinations thereof.

33. The method according to claim 32, wherein the first fluorinated oil component is a perflubropolyether oil.

34. The method according to claim 32, wherein the first fluorinated oil component is selected from the group consisting of compounds corresponding to:

$$CF_3CF_2CF_2—O[CF(CF_3)CF_2—O]_nCF_2CF_3,$$

$$CF_3O[CF(CF_3)CF_{2—O]y}—[CF_2—O]_mCF_3,$$

$$CF_3O[CF(CF_3)CF_2—O]_z—[CF_2—O—]_pCF_3,$$

$$CF_3CF_2CF_2—O—[CF_2CF_2CF_2—O—]_qCF_2CF_3, \text{ and}$$

halocarbons containing the repeating group—$(CF_2CFCl)_r$— and combinations thereof; wherein n is an integer from 0 to 60; y is an integer from 0 to 60; m is an integer from 0 to 60; z is an integer from 0 to 60; p is an integer from 0 to 60; q is an integer from 0 to 60; and r is an integer from 2 to 10.

35. The method according to claim 32, wherein the first fluorinated oil component corresponds to the formula $F[CF(CF_3)CF_2O]_nCF_2CF_3$.

36. The method according to claim 32, further adding a material selected from the group consisting of anti-wear andextreme pressure additives, thermal stabilizing additives, corrosion inhibitors, lubricity additives, oxidation inhibitors, and combinations thereof.

37. The method according to claim 32, further comprising combining an additional fluorinated component selected from the group consisting of perfluorocarbons, dihydropolyfluoroalkanes having 5 to 7 carbons, trihydropolyfluoroalkanes having 5 to 7 carbons, and combinations thereof.

38. A method of using the composition according to any one of claim 1 to 4 and 6 to 24 to compatibilize incompatible materials, a step of which comprises:

a) providing said composition to a mixture of two or more incompatible materials.

* * * * *